United States Patent [19]

Leachman, Jr.

[11] Patent Number: 4,629,394

[45] Date of Patent: Dec. 16, 1986

[54] CENTRIFUGAL PUMP HAVING LOW FLOW DIFFUSER

[75] Inventor: Frank A. Leachman, Jr., Bristol, Conn.

[73] Assignee: Chandler Evans Inc, West Hartford, Conn.

[21] Appl. No.: 516,848

[22] Filed: Jul. 25, 1983

[51] Int. Cl.[4] ..... F04D 15/00; F04D 27/00

[52] U.S. Cl. ..... 415/38; 415/26; 415/49

[58] Field of Search ..... 415/13, 27, 38, 39, 415/40, 47, 101, 102, 182, 206, 207, 46, 208, 209, 211, 219 C, 26, 49, 144, 145, 146

[56] References Cited

U.S. PATENT DOCUMENTS

| | | | |
|---|---|---|---|
| 3,244,109 | 4/1966 | Barske | 415/211 |
| 3,246,605 | 4/1966 | Fisher | 415/211 |
| 3,576,375 | 4/1971 | Jackson | 415/143 |
| 3,802,796 | 4/1974 | Bottoms | 415/144 |
| 3,851,998 | 12/1974 | Downing | 417/201 |
| 4,487,548 | 12/1984 | Leachman, Jr. et al. | 415/28 |

FOREIGN PATENT DOCUMENTS

| | | | |
|---|---|---|---|
| 0295850 | 4/1912 | Fed. Rep. of Germany | 415/211 |
| 0285595 | 8/1913 | Fed. Rep. of Germany | 415/211 |
| 101871 | 7/1925 | Fed. Rep. of Germany | 415/144 |
| 0187426 | 12/1955 | Fed. Rep. of Germany | 415/211 |

*Primary Examiner*—Robert E. Garrett
*Assistant Examiner*—H. Edward Li
*Attorney, Agent, or Firm*—Richard A. Dornon

[57] ABSTRACT

A centrifugal main fuel pump (10') for a gas turbine engine has a housing (18') in which a centrifugal impeller (12') is mounted for rotation. The impeller discharges flow to a collector (20') and diffuser (22'). A low flow diffuser (26) has its inlet opening positioned closely adjacent the outer periphery of the impeller. Proper design and placement of the low flow diffuser ensures that a high percentage of the fluid energy available in the high velocity flow adjacent the impeller outer periphery is recovered as pressure rise. The low flow diffuser produces adequate fuel flow at the pressure necessary for engine light-off while the first mentioned diffuser recovers a lower pressure rise but is adapted to supply higher engine fuel flow demand in the normal range of operation. A check valve (34) prevents flow from the low flow diffuser from returning to the impeller. The check valve opens to allow the first mentioned diffuser to supply fuel when its discharge pressure exceeds that of the low flow diffuser. The addition of the low flow diffuser to the centrifugal pump results in minimal additional parasitic power loss, cost and complexity.

8 Claims, 10 Drawing Figures

CENTRIFUGAL PUMP HAVING LOW FLOW DIFFUSER

TECHNICAL FIELD

This invention relates to centrifugal fluid pumps for pumping fuel to gas turbine engines.

BACKGROUND ART

Typically, gas turbine engine fuel controls utilize positive displacement pumps to supply fuel at the necessary high pressures. However, positive displacement pumps require close operating clearances and contain parts with highly stressed metal-to-metal contacts which wear rapidly in low lubricity fuel. In addition, the performance of positive displacement pumps may be adversely affected by the presence of contaminants.

While high speed centrifugal pumps are relatively insensitive to contaminants and are capable of generating the fuel pressures required for engine operation in their normal speed range, such pumps will not generate sufficient fuel pressure at engine light-off or cranking speed (which may typically be 10% to 20% of maximum engine speed). In order to overcome the aforementioned drawback centrifugal pumps have been combined with positive displacement pumps to form pumps capable of extending the lower range of operation. An example of such a combination pump is shown in U.S. Pat. No. 3,851,998. The major undesirable characteristic of a combination pump is that it must be relatively complex.

U.S. Pat. No. 3,576,375 offers a solution to the previously discussed problems by providing a fuel pump with two impeller elements, one for starting and one for normal operation. While the latter described arrangement may successfully pump fuel at the necessary pressures, it requires that the two impeller elements be mounted in separate chambers and interconnected by means such as a common drive shaft. Moreover, the chamber in which the starting impeller is located must be drained of fluid to eliminate fluid resistance during normal operation or alternatively, some form of clutch mechanism must be employed.

DISCLOSURE OF THE INVENTION

In accordance with the invention, there is provided a centrifugal pump which incorporates a conventional centrifugal impeller, collector and diffuser and additionally includes a separate smaller diffuser in parallel flow relationship with the main diffuser adapted to collect flow for engine starting and low flow operation. The small diffuser, in a pump of the invention, may be advantageously located as near as possible to the impeller periphery where the fluid velocity approaches its maximum value whereby the greatest headrise recovery may be attained. While the exact positioning of the small diffuser admits of many variations, the type of collector present in the pump will be one of the controlling factors in its selection.

In a pump of the invention, the provision of a small diffuser permits the centrifugal impeller to be configured whereby the pump can run closer to design flow conditions at low flows so as to engender minimal heat rejection to the fluid being pumped and reduced power consumption.

Accordingly, it is a primary object of the invention to provide a centrifugal fuel pump which has a small diffuser adapted to collect flow for engine starting and/or low flow operation.

This and other objects and advantages of the invention will become more readily apparent from the following detailed description, when taken in conjunction with the accompanying drawings, in which:

BEST MODE OF CARRYING OUT THE INVENTION

Figure 1:
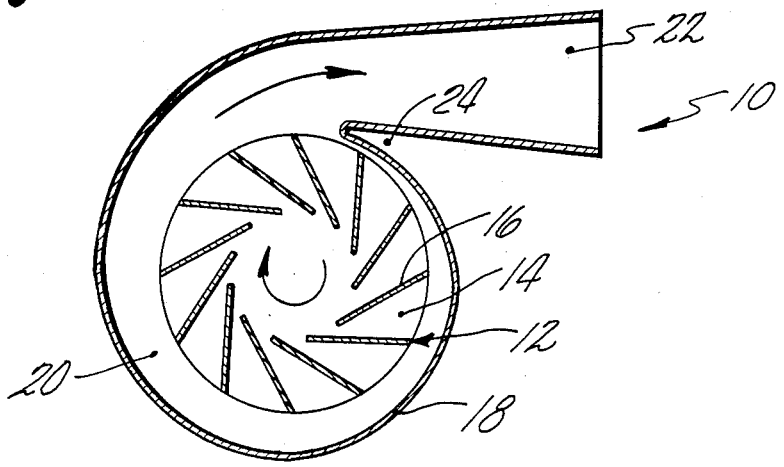
FIG. 1 is a schematic front elevational view of a conventional centrifugal pump having a volute collector.

With reference to FIG. 1, there is shown a conventional centrifugal pump, generally indicated at 10. Pump 10 includes a centrifugal impeller 12 comprised of a disk 14 which carries blades 16. The impeller 12 is mounted for rotation within a pumping cavity defined within a pump housing 18. The pump housing 18 also has defined therein a volute collector 20, which receives flow from the impeller blades 16, and a diffuser 22 which receives flow from the volute collector 20. The protruding wedge-shaped portion of the housing disposed between the entry segment of the volute 20 and the diffuser 22 is commonly termed the cutwater 24 and typically embodies a rounded leading edge.

Succinctly stated, the volute 20 and diffuser 22 function to recover the dynamic head imparted to the fluid by the impeller 12. In a typical centrifugal pump, the velocity of the fluid emanating from the impeller periphery is reduced to about one-half of its original exit velocity when it enters the volute collector. The mixing of the flow leaving the impeller with the slower moving fluid in the volute collector occasions fuel heating. Hence, much of the energy in the flow leaving the impeller is not recoverable as pump headrise; only one-half to two-thirds of the theoretically available headrise is typically recovered in the diffuser.

At extremely low flows (e.g., 3% of the flow capacity of the pump), the fluid in the impeller rotates in what approximates a pure forced vortex. It is believed that, as the fluid departs the outer periphery of the impeller, it undergoes velocity reductions as in a free vortex until abruptly slowed by the complex flow patterns in the volute collector. As will be described hereinafter, a pump of the invention utilizes the flow from the outer edge of the fluid forced vortex, which has a velocity close to that of the impeller tip speed. In this regard, it should be noted that experimentation has confirmed that uniform diffusion from a point at the aforementioned location may result in recovery of about 80% of the theoretically available headrise.

It should be readily apparent that by providing a secondary or low flow diffuser to tap flow from the outer edge of the forced fluid vortex, the low flow pressure rise obtainable will be about 20% to 60% greater than that of the main flow. By incorporating such a secondary diffuser in a centrifugal pump, a smaller impeller than would otherwise be required may be employed since the impeller need not be sized to generate sufficient pressure at engine light-off speed in the main flow diffuser. Wasted power reductions of the order of 35% at 100% engine speed may be realizable when a secondary diffuser is installed. Therefore, fuel temperature rise during high speed, low through flow operation may be minimized.

Figure 2:
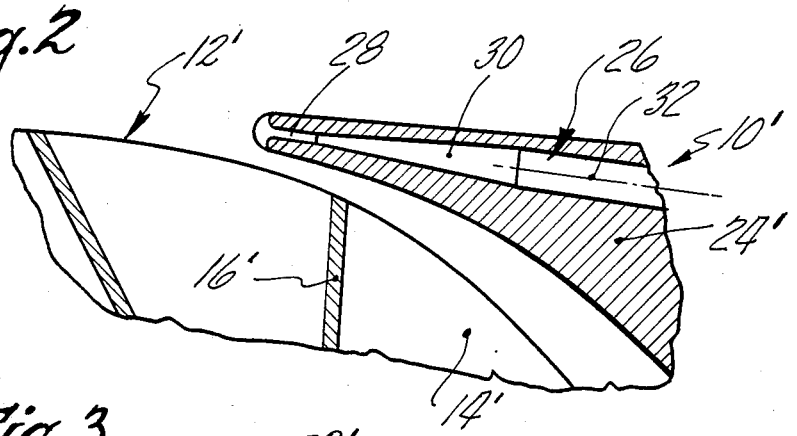
FIG. 2 is an enlarged fragmentary front elevational view of a pump according to the invention showing the low flow diffuser in the cutwater.

Referring to FIG. 2, wherein like primed numerals designate like elements, an example of a centrifugal pump with a secondary or low flow diffuser is presented. The pump of FIG. 2 is identical to that of FIG. 1, save for the inclusion of a secondary or low flow diffuser, generally shown at 26 in the cutwater 24' which forms a projecting portion of the housing 18' and extends into the collector 20'. The leading edge of the cutwater in the pump having a volute collector is, because of its shape and placement, a convenient location for picking up fluid moving at a velocity close to that of the impeller tip speed. In addition, the wedge-shape of the cutwater 24' provides ample space for housing the low flow diffuser 26 and allows it to be disposed in an orientation where its axis is nearly aligned with the velocity vector of the flow impinging upon the leading edge of the cutwater.

The low flow diffuser 26 has an entrance segment 28 with a converging inlet opening communicating with the leading edge of the cutwater 24'. The entrance segment 28 directs flow to a conical segment 30 which, in turn, communicates with a low flow discharge conduit 32. Flow from the low flow discharge conduit is adapted to fulfill the starting and low flow operation requirements.

Figure 3:
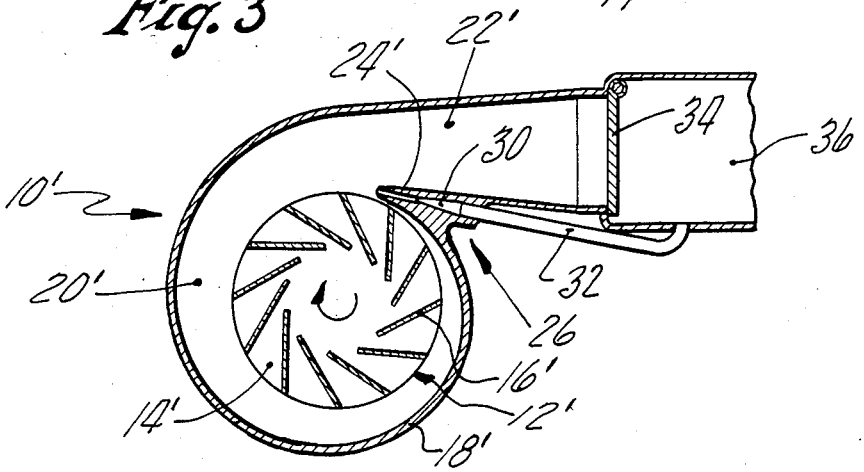
FIG. 3 is a schematic view of a preferred pumping system of the invention incorporating the diffuser arrangement of FIG. 2.

FIG. 3 depicts the pump of FIG. 2 incorporated in a preferred pumping system. A lightly loaded, flapper type check valve 34 is interposed between a common discharge conduit 36 and the main flow diffuser 22'. Downstream of the check valve 34, the low flow discharge conduit 32 joins the common discharge conduit 36. The low flow discharge conduit 32 communicates with the low flow diffuser 26, which is in parallel flow relationship with the main flow diffuser 22', for carrying starting flow to the common discharge conduit 36. The check valve 34, which is shown in its closed position, is spring loaded to this closed position wherein the discharge opening of the diffuser 22' is sealed. In the closed position of check valve 34, flow from the conduit 32 is prevented from returning to the impeller 12' via the diffuser 22' and the collector 20' during cranking or low flow operation. It will be appreciated that, in the low speed range of engine operation, the pressure at the discharge of the low flow diffuser 26 is greater than at the discharge of the main flow diffuser 22' thereby maintaining the check valve 34 in its closed position.

In operation, engine starting flow proceeds to the common discharge conduit 36 from the starting flow diffuser 26 through the conduit 32, return flow to impeller 12' being blocked by the closed check valve 34. As engine speed increases, fuel flow demand correspondingly increases. Increased fuel flow results in greater fluid velocities and consequent greater pressure losses in the starting flow diffuser 26, thereby reducing fluid pressure in conduits 36 and 32. As a consequence of continued increase in engine flow demand, the pressure in conduit 36 will be exceeded by the pressure upstream of the check valve 34 due to the pressure generated in the main flow diffuser 22'. When the pressure differential across the check valve 34 is sufficient to overcome the bias of its spring, the valve 34 will open whereby engine fuel flow will be provided by the main flow diffuser 22'. Since the main flow diffuser has a far greater flow capacity than the starting flow diffuser 26, further increases in fuel flow will result in a lower magnitude of pressure losses in the main flow diffuser 22' than in the low flow diffuser 26. Therefore, as fuel flow continues to increase in the normal range of engine operation, substantially all additional flow will be generated by the main flow diffuser.

In certain applications, it may be necessary or desirable to effect transition from the starting flow diffuser 26 to the main flow diffuser 22' at an engine speed below the normal operating range of the main flow diffuser 22' such that pressure transition will not adversely affect engine fuel control operation. To this end, a valve, generally indicated at 38 in FIG. 4, may be interposed in the conduit 32 for controlling flow therethrough. Valve 38 comprises a spool 40 having its upper and lower surfaces referenced to inlet pressure (via a pressure sense line 42) and the pressure in the collector 20' (via a pressure sense line 44), respectively. A spring 46 urges the spool 40 downwardly to a position in which an annular recess 48 on spool 40 allows unrestricted flow in the conduit 32. It should be apparent that by moving the spool 40 upwardly against the bias of spring 46, the conduit 32 can be closed to further flow from the starting flow diffuser 26.

Should it be desired to occasion a transition from starting flow to main flow at, for example, near 25% of maximum rated speed, the spool areas and the spring preload should be selected such that the forces on the spool are in balance at that particular speed. It will be appreciated that the pressure rise produced by the main flow diffuser at any given speed is easily determinable. At engine speeds above the selected transition speed, the valve 38 will be maintained in its upper position by the pressure forces acting thereupon, thereby shutting off conduit 32 and preventing starting flow from reaching discharge conduit 36. Upon the closure of the valve 38, the pressure in the discharge conduit 36 will be reduced such that check valve 34 will open and flow from the main flow diffuser 22' will be allowed to proceed to the engine via conduit 36.

Figure 5:
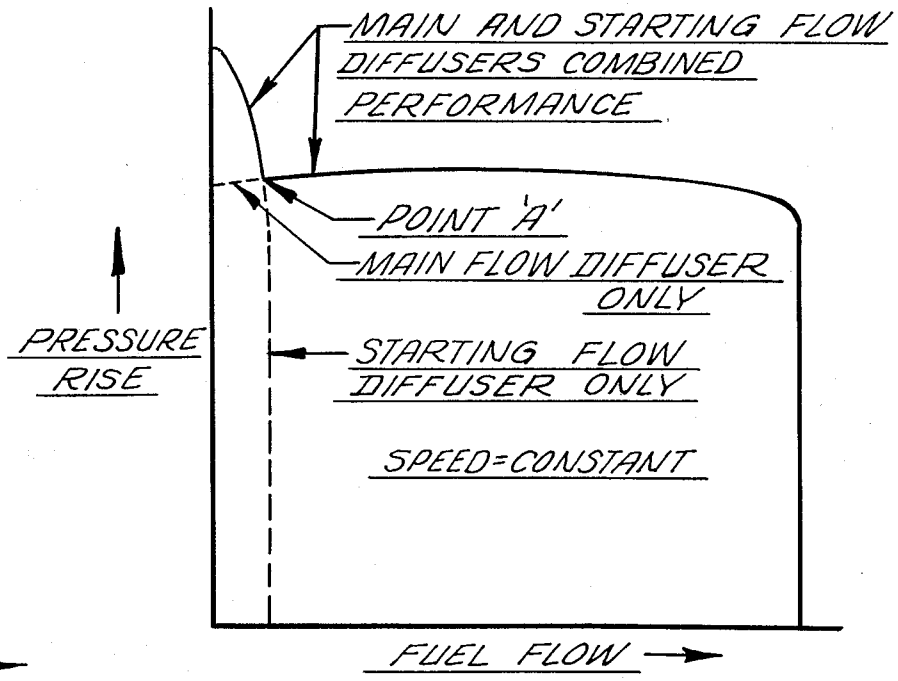
FIG. 5 is a graph depicting performance of a pumping system as shown in FIG. 3.

With reference to FIG. 5, typical examples of pressure vs. flow curves are presented for the starting flow diffuser and the main flow diffuser for a given speed. The dashed lines in the graph reflect the individual performance characteristics of the starting flow diffuser and the main flow diffuser, respectively. The solid line shows the combined performance of the diffuser in conjunction with the valving depicted in FIG. 3. It will be noted that after the rate of fuel flow increases beyond that of point A on the chart, the check valve 34 will open, thereby permitting the main flow impeller elements to provide flow.

It will be appreciated that it may be advantageous to use a centrifugal pump having a concentric constant area collector instead of a volute collector in carrying out the invention. The concentric collector may reduce pump temperature rise during low through flow operation by permitting the creation of a more perfect free vortex in the collector. This would be due to the diffuser entrance engendering minimal disturbance to the vortex flow.

Figure 6:
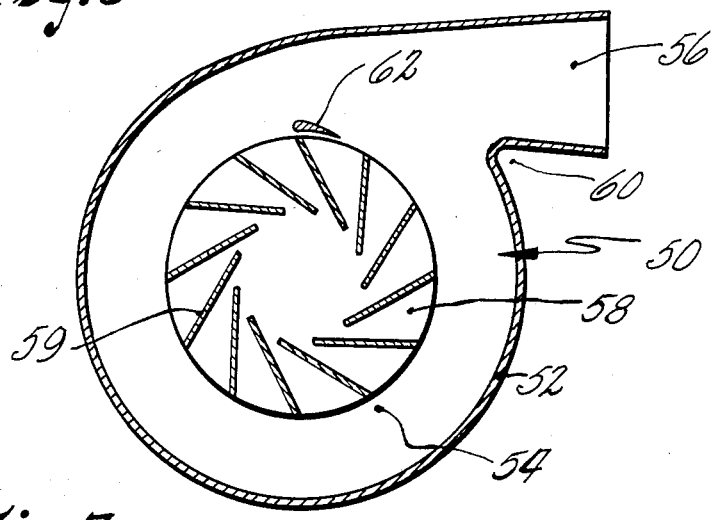
FIG. 6 is a schematic front elevational view of a centrifugal pump having a constant area collector which embodies another form of low flow diffuser according to the invention.
Figure 7:
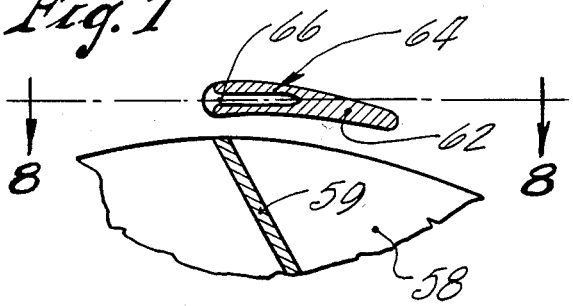
FIG. 7 is an enlarged fragmentary front elevational view, partly in section, of the pump of FIG. 6, showing the diffuser in the fairing.
Figure 8:
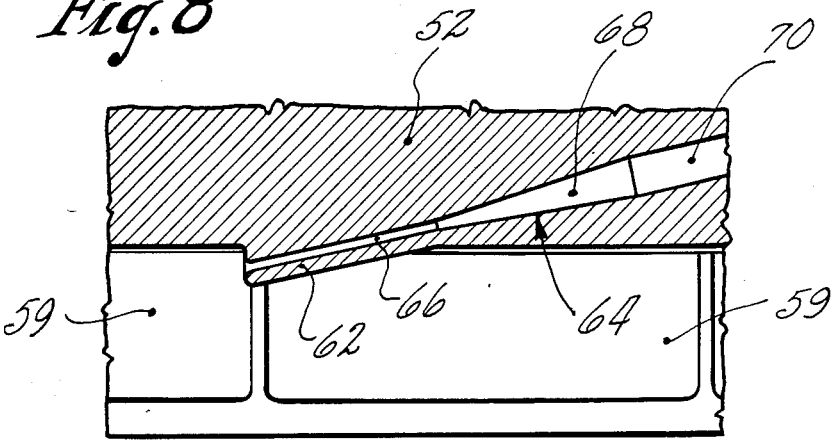
FIG. 8 is a sectional view of the fairing, taken substantially along the line 8—8 of FIG. 7.

FIGS. 6–8 show a centrifugal pump, generally designated 50, having a housing 52 which defines a concentric, constant area collector 54 and diffuser 56. An impeller 58 having blades 59 is mounted for rotation within a pumping cavity in the housing. The housing 52 also comprises a cutwater 60. Because the cutwater 60 is a manifestly unsuitable location for the low flow diffuser, means must be furnished for placing of the low flow diffuser in a favorable position. To this end, there is provided an airfoil-shaped fairing or rib 62, integral with and constituting a part of the housing wall which borders the side of the collector 54 and projecting into the flow stream closely adjacent to the periphery of the impeller 58.

Figure 4:
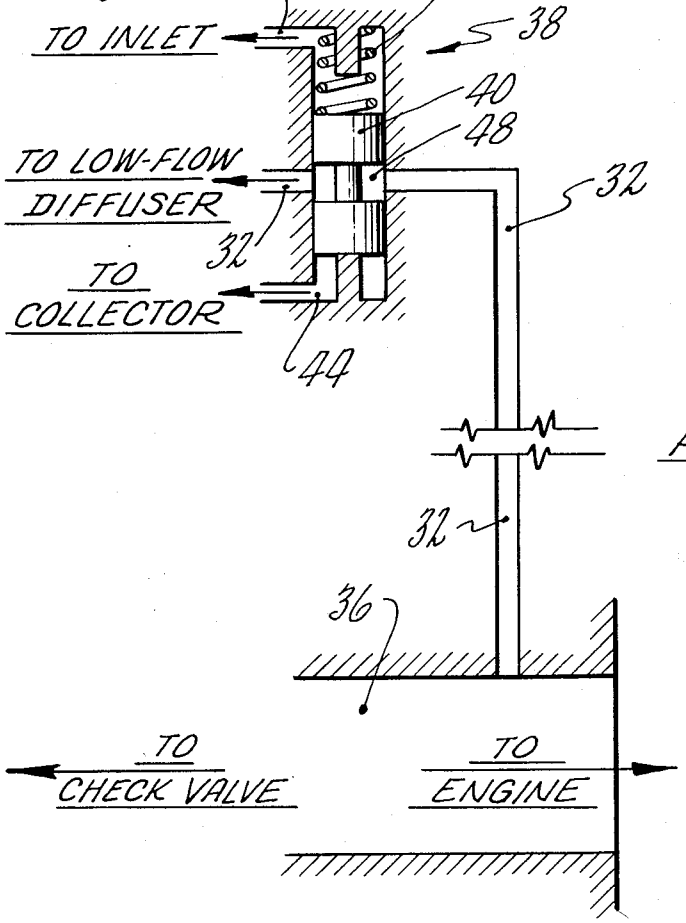
FIG. 4 shows a modification to the pumping system of FIG. 3.

As best shown in FIGS. 7 and 8, the fairing 62 embodies a portion of a low flow diffuser, generally designated 64, which is essentially similar in construction and operation to that of the low flow diffuser 26 of FIG. 2. The low flow diffuser 64 has an entrance segment 66, which is partially contained in the fairing 62 and communicates with the leading edge of the fairing 62. The entrance segment extends into the housing 52 at a small angle to the housing wall and joins a conical diffusing segment 68 which directs flow to a low flow discharge conduit 70. A pumping system, which includes the pump of FIGS. 6–8, may also embody valving as depicted in FIGS. 3 and 4. For a particular pump, the optimum extent of projection of the fairing 62 into the flow stream would be selected after experimentation to ascertain where minimum wall shear and other losses are encountered.

Figures 9, 10:
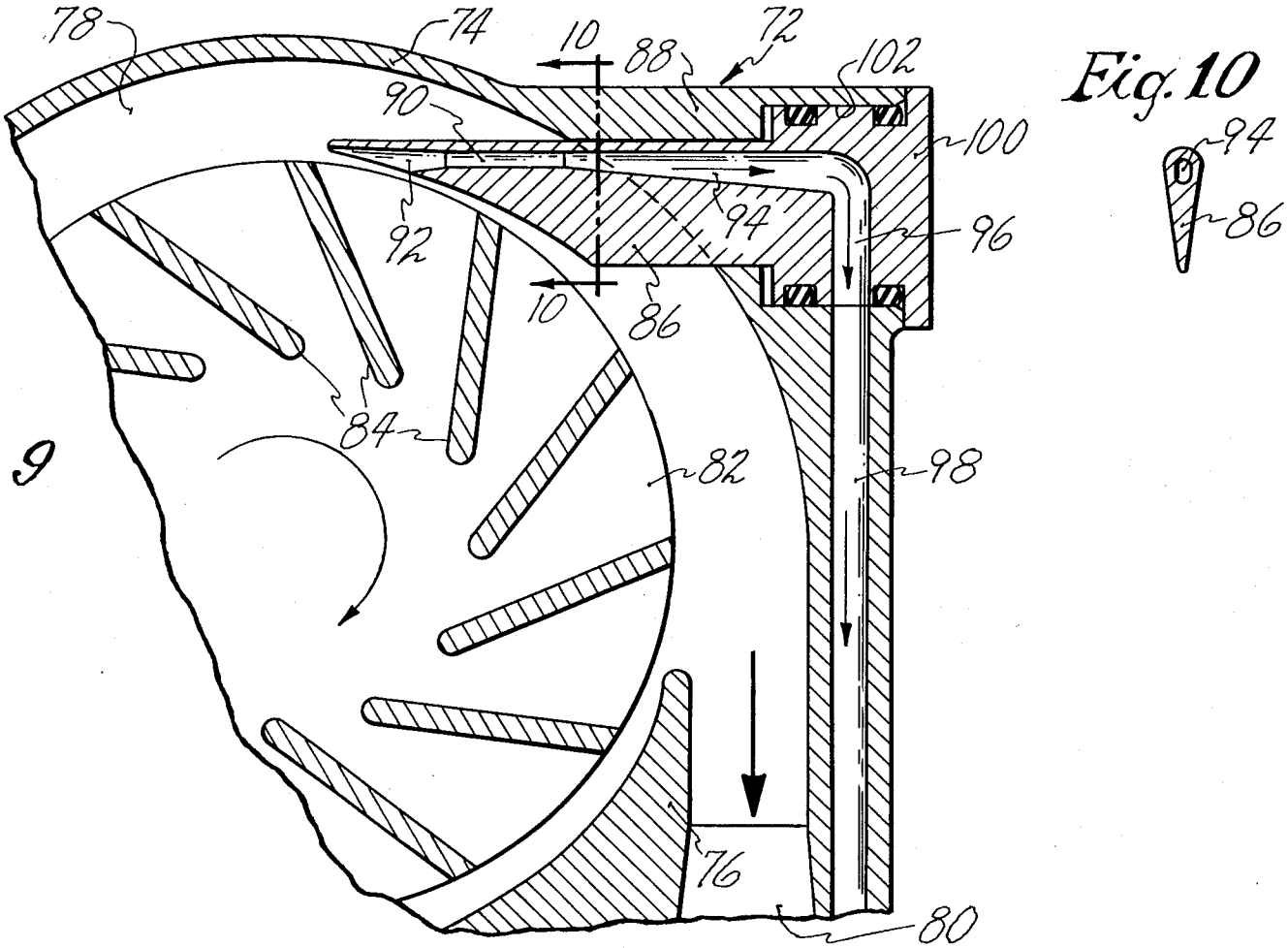
FIG. 9 is a schematic front elevational view of a centrifugal pump which embodies yet another form of low flow diffuser according to the invention.
FIG. 10 is a sectional view of the strut taken substantially along the line 10—10 of FIG. 9.

FIG. 9 depicts another embodiment of the invention in which the low flow diffuser is positioned in an optimum location such that the entrance thereto is exposed to maximum static pressure. The static pressure in any collector varies with the rotational angle (i.e., degrees of arc) from the cutwater. At any station, the static pressure in a collector is somewhat difficult to determine analytically and is best determined through experimentation. In general, the location of maximum static pressure will be a function of the collector shape and the flow rate. Obviously, by placing the entrance to the low flow diffuser at the location of maximum static pressure during low flows, the maximum head (i.e., dynamic head plus static pressure head) may be recovered in the low flow diffuser.

As shown in FIGS. 9 and 10 a centrifugal pump, generally indicated at 72, has a housing 74 having a cutwater 76, a collector 78 and a diffuser 80. An impeller 82 having blades 84 is mounted for rotation within a pumping cavity in the housing 74. The housing includes a slender knife-shaped strut or probe 86 having an acruate shaped leading edge, mounted in an extension 88 of the housing 74 such that it projects into the collector 78. Probe 86 embodies a low flow diffuser having an entrance segment 90 with a converging inlet opening 92 adjacent the end of the probe, a conical diffusing segment 94 and a low flow discharge conduit 96 which communicates with a low flow discharge conduit 98 in the housing 74. The probe 86 is secured to the housing 74 by appropriate means (not shown) and has a cylindrical end 100 incorporating O-rings mounted in a cavity 102 in the housing 74. It will be noted that valving as shown in FIGS. 3 and 4 may be associated with the pump of FIGS. 9 and 10.

The inlet opening 92 is, of course, closely adjacent the periphery of the impeller and is also located at the location of maximum static pressure which is illustrated as being spaced about 90° from the leading edge of the cutwater 76. Since the cross sectional flow area of the collector is reduced by insertion of such a probe, some head losses could be occasioned. However, it will be appreciated that such head losses may be minimized by enlarging the collector channel in the region of the probe to thereby maintain the original collector flow area.

With the low flow diffuser of any of the embodiments adapted to provide, for example, 3% of total flow, it will be appreciated that it will receive this same percentage of flow in normal engine operation as in engine starting. Since the idle descent phase of aircraft operation will generally result in pump through flows below the 3% level, fuel temperature increases during this phase of operation will be reduced below that which could be engendered by a conventional centrifugal pump.

Obviously, many modifications and variations are possible in light of the above teachings without departing from the scope or spirit of the invention as defined in the appended claims.

What is claimed is:

1. An improved centrifugal fuel pumping system for a gas turbine engine adapted to fulfill starting and low flow engine operation requirements of the type comprising:

a housing having an inlet, a pumping cavity in fluid communication with the inlet, a collector adapted to receive flow from the pumping cavity and a diffuser adapted to receive flow from the collector; and an impeller mounted for rotation within the pumping cavity; wherein the improvement comprises:

the housing having a projecting portion extending into the collector, the projecting portion having an inlet opening on the leading edge thereof closely adjacent the outer periphery of the impeller for recovering a portion of the high velocity impeller discharge flow;

a low flow diffuser in parallel flow relationship with the first mentioned diffuser located in the housing and in communication with the inlet opening for receiving flow therefrom;

a low flow discharge conduit in fluid communication with the low flow diffuser for receiving flow therefrom;

a common discharge conduit in fluid communication with the first mentioned diffuser and the low flow discharge conduit for carrying the total flow from both of the diffusers to the engine during starting, normal and low flow engine operation; and check valve means for preventing flow from the low flow diffuser from entering the first mentioned diffuser during the starting and low flow operation when the pressure in the first mentioned diffuser is less than the pressure in the common discharge conduit and for allowing flow from the first mentioned diffuser to enter the common discharge conduit when the pressure in the first mentioned diffuser is greater than the pressure in the common discharge conduit.

2. The pumping system of claim 1, wherein the improvement further comprises:

a shutoff valve means to shutoff flow from the low flow difusser to the common discharge conduit when the impeller exceeds a predetermined speed of rotation.

3. The pumping system of claim 1, wherein the collector is a volute collector and wherein the projecting portion includes a cutwater defined between the entrance to the volute and the first mentioned diffuser, and wherein the inlet opening is on the leading edge of the cutwater.

4. The pumping system of claim 1, wherein the collector is a concentric collector and wherein the projecting portion comprises:

a rib projecting into the collector such that it is closely adjacent the outer periphery of the impeller; and wherein the inlet opening is on a surface of the rib.

5. The pumping system of claim 4, wherein the rib is shaped as an airfoil and includes a leading edge and wherein the inlet opening is on the leading edge.

6. The pumping system of claim 1, wherein the projecting portion comprises:

a probe projecting into the collector; and wherein the inlet opening is adjacent the end of the probe and at a location of maximum static pressure.

7. The pumping system of claim 6, wherein the cross sectional area of the collector is enlarged in the region of the probe so as not to reduce the collector flow area.

8. An improved method of recovering flow from the collector of a gas turbine engine centrifugal fuel pump having a housing and an impeller therein which method is of the type comprising the step of: directing flow from the collector to a diffuser; and wherein the improvement comprises the steps of:

directing flow from the collector to an inlet opening on a projecting portion of the housing, which inlet opening is closely adjacent the outer periphery of the impeller, for recovering a portion of the high velocity impeller discharge flow;

directing flow from the inlet opening to a low flow diffuser in parallel flow relationship with the first mentioned diffuser;

directing flow from the low flow diffuser to a common discharge conduit in fluid communication with the first mentioned diffuser;

directing the total flow from both of the diffusers through the common discharge conduit to the engine during starting, normal and low flow engine operation;

preventing flow from the low flow diffuser from entering the first mentioned diffuser during the starting and the low flow operation when the pressure in the first mentioned diffuser is less than the pressure in the common discharge conduit; and allowing flow from the first mentioned diffuser to enter the common discharge conduit when the pressure in the first mentioned diffuser is greater than the pressure in the common discharge conduit.

* * * * *